US007685702B2

(12) United States Patent
Sutter et al.

(10) Patent No.: US 7,685,702 B2
(45) Date of Patent: Mar. 30, 2010

(54) WIRE INSERTION TOOL FOR PUSH-IN WIRE CONNECTORS

(75) Inventors: Robert W. Sutter, DeKalb, IL (US); David Niemi, DeKalb, IL (US); Jacob C. Ward, Ames, IA (US)

(73) Assignee: IDEAL Industries, Inc., Sycamore, IL (US)

( * ) Notice: Subject to any disclaimer, the term of this patent is extended or adjusted under 35 U.S.C. 154(b) by 255 days.

(21) Appl. No.: 11/835,149

(22) Filed: Aug. 7, 2007

(65) Prior Publication Data

US 2008/0098593 A1 May 1, 2008

Related U.S. Application Data

(60) Provisional application No. 60/821,663, filed on Aug. 7, 2006.

(51) Int. Cl.
*H01R 43/00* (2006.01)

(52) U.S. Cl. ..... 29/749; 29/566.3; 29/566.4; 29/750; 29/751; 29/752; 29/753; 29/754; 29/759; 294/16; 294/88; 294/113; 294/116; 81/342; 81/345; 81/347

(58) Field of Classification Search ..... 29/748, 29/749, 750, 758, 760, 270, 854, 857, 566.4, 29/566.3, 759, 752–754; 439/805, 384, 385, 439/392, 441; 81/342, 345, 347; 294/16, 294/88, 113, 116
See application file for complete search history.

(56) References Cited

U.S. PATENT DOCUMENTS 4,534,107 A * 8/1985 Maack ..... 29/751
4,642,874 A * 2/1987 Litehizer, Jr. ..... 29/566.4
6,877,218 B2 * 4/2005 Perea et al. ..... 29/749

* cited by examiner

*Primary Examiner*—Derris H Banks
*Assistant Examiner*—Azm Parvez
(74) *Attorney, Agent, or Firm*—Cook Alex Ltd

(57) ABSTRACT

A wire insertion tool for a push-in wire connector has a frame and a slide assembly mounted for reciprocating motion on the frame. The frame includes a carriage on which a push-in wire connector is mounted. The slide assembly carries a wire holder which mounts an electric wire opposite the wire connector. An actuator extends to advance the slide assembly and carry a wire in the holder in a direction parallel to the axis of the wire. Advancement of the wire holder inserts the wire into the connector. The wire holder is then released and the slide assembly is retracted to prepare for the next insertion cycle.

10 Claims, 8 Drawing Sheets

WIRE INSERTION TOOL FOR PUSH-IN WIRE CONNECTORS

CROSS-REFERENCE TO RELATED APPLICATION

This application claims the benefit of priority from U.S. Provisional Patent Application No. 60/821,663 titled "Wire Insertion Tool for Push-in Wire Connectors", filed on Aug. 7, 2006, the entire contents of which are herein incorporated by reference.

BACKGROUND OF THE INVENTION

Push-in wire connectors are a well-known type of wire connector having an electrically-insulating housing in which a conductive wire retainer is disposed. The housing has two or more openings therein through which the stripped ends of electrical wires can be inserted. The bare ends of the inserted wires engage the wire retainer in the interior of the housing. The wire retainer is often in the form of a spring clip. The spring clip includes spring fingers which are arranged to receive wires pushed into the housing and then grab or hold the wires to prevent them from being pulled out of the housing. The inserted wires are electrically connected to one another by the clip. A variation of this construction is a releasable push-in connector which has a spring finger which can be manipulated by a user to release the inserted wires and allow them to be retracted from the housing. Examples of push-in wire connectors are shown in U.S. Pat. Nos. 4,824,395 and 6,746,286, the disclosures of which are hereby incorporated by reference.

Push-in connectors are an alternative to twist-on wire connectors. In high volume applications push-in connectors may be used as an alternative to twist-on wire connectors in an attempt to avoid possible issues relating to repetitive stress injuries or trauma such as carpal tunnel syndrome. However, in certain situations this effort can be largely futile as the user is simply trading one repetitive motion for another. That is, the pincer-like finger grip of a wire required by the manual use of a push-in connector can be, for those so disposed, as much of a problem as the wrist twisting motion required by manual installation of a twist-on connector.

Another problem with push-in connectors occurs when they are used with stranded wires. Stranded wires have a tendency to buckle as they are inserted into a push-in connector by hand, especially if the user's grip is remote from the end of the wire. Or sometimes if the wire isn't carefully aligned with the housing opening some of the strands may get separated from the bulk of the strands and these individual strands get hung up on the exterior of the housing. For obvious safety reasons this is undesirable.

SUMMARY OF THE INVENTION

The afore-mentioned problems are overcome by the present invention which provides a tool for installing wires into push-in connectors. The tool has a bed which includes a carriage where a push-in connector is momentarily fixed. A reciprocating slide is mounted to the bed and carries a wire holder for reciprocal motion. The wire holder grasps a wire with the stripped end of the wire opposite an opening of the fixed connector. The slide advances the wire holder in a direction parallel to the axis of the wire, thereby inserting the bare end of the wire into the connector housing. The wire holder then releases its grasp of the wire and the slide is retracted. Either the connector or the wire holder is indexed to align the wire holder with the next housing opening. Then another wire is placed in the holder for insertion into the connector and the translation step is repeated. When all of the wires are inserted the filled connector is released from the carriage and the next connector is presented. Alternately, the wire holder could be arranged to hold multiple wires opposite the housing openings. Then all wires could be installed in a single translation of the slide and wire holder. In such a case the filled connector could be removed from the carriage before, during or after retraction of the slide wire holder.

BRIEF DESCRIPTION OF THE DRAWINGS

FIGS. 3 and 4 are perspective views of the wire installation tool of the present invention, shown in the fully retracted position with a push-in connector and a stripped electrical wire loaded therein. Again the line of sight of FIG. 3 is close to a top plan view while FIG. 4 is mostly from the side of the tool.

FIG. 6 is nearly a side elevation view.

FIGS. 7 and 8 are perspective views of the wire installation tool of the present invention, shown in the abutted advanced position with the wire holder jaws still locked onto a wire. The line of sight of FIG. 7 is primarily a top plan view while FIG. 8 is primarily a side elevation view.

FIGS. 9 and 10 are perspective views of the wire installation tool of the present invention, shown in the fully advanced position with the wire holder jaws unlocked and ready for retraction. The line of sight of FIG. 9 is largely a top plan view while FIG. 10 is largely a side elevation view.

DETAILED DESCRIPTION OF THE INVENTION

Figure 1:
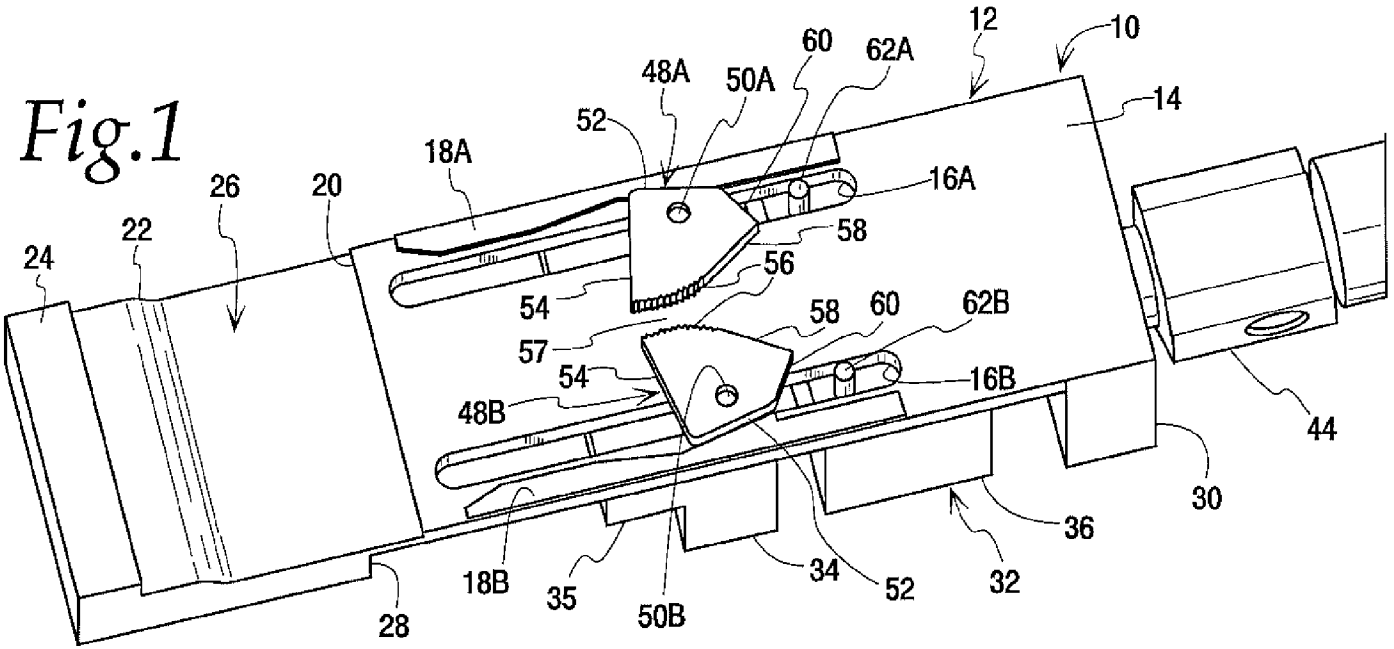
FIGS. 1 and 2 are perspective views of the wire installation tool of the present invention, shown in the fully retracted position ready for parts to be loaded. The line of sight of FIG. 1 is largely a top plan view while FIG. 2 approaches a side elevation view.
Figure 2:
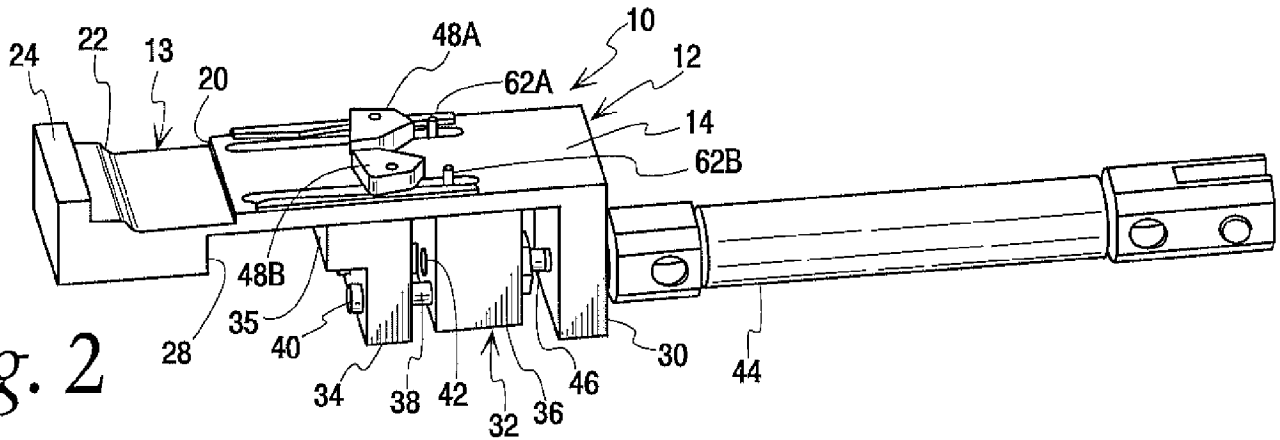

A wire insertion tool according to the present invention is shown generally at 10 in FIGS. 1 and 2. It includes a frame 12 having a rectangular, generally flat base plate or bed 14. The bed has a pair of elongated slots 16A, 16B which extend through the entire thickness of the bed. The top surface of the bed has a pair of cam rails 18A, 18B adjacent the slots 16A,B on the lateral edges of the bed 14. The cam rails may be fixed to the bed. Alternately, the cam rails could be adjustably mounted on the bed to adjust the point at which the gripping fingers or jaws close or open on a wire, as will be explained below. Toward one end of the bed there is a depression which defines a notch 20. Axially spaced from the notch there is a riser 22 that terminates at a ledge 24. Together the notch 20, riser 22 and ledge 24 define a carriage 26. Underneath the carriage the bed has a portion of increased thickness that defines an abutment 28. At the opposite end of the bed from the abutment there is a bracket 30 attached to the underside of the bed. The bracket may be integrally formed with the bed as shown, or alternately it may be a separate part suitably fixed to the bed.

A slide assembly 32 is mounted for reciprocating motion on the underside of the bed 14. The slide assembly includes a jaw block 34, an unlocking block 36, guide rods 38 with heads 40, and a compression spring 42. The blocks 34, 36 are free to move longitudinally of the bed, but not laterally. The jaw block 34 has an inverted L-shape which includes a nose portion 35. The vertical leg of the jaw block has horizontal bores therethrough which receive the guide rods 38.

Figure 9:
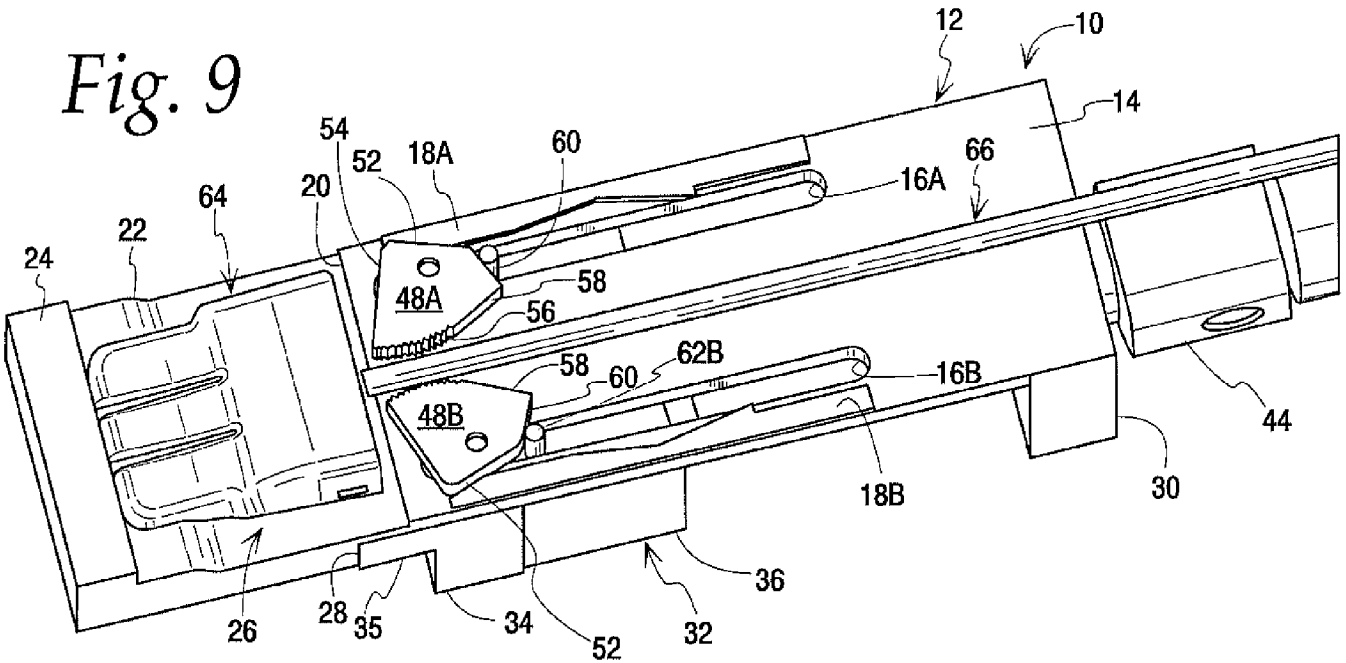
Figure 10:
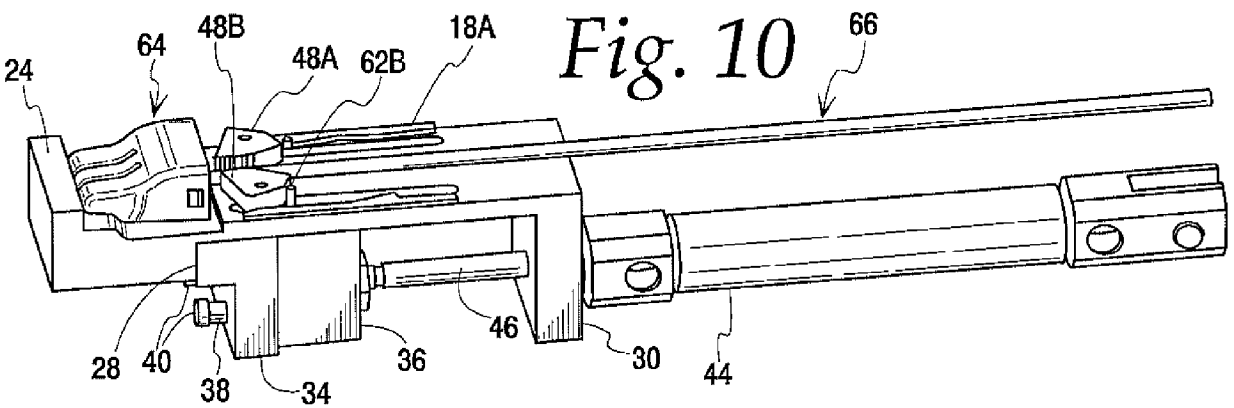

One of the guide rods is seen at 38. The guide rods have one end fixed in the unlocking block 36. The rods extend from the unlocking block through the bores in the jaw block 34, terminating at a nut or head 40. Thus, the jaw block is slidably mounted on the rods 38. The nut or head 40 on the free ends of the rods prevents the jaw block from sliding off the rods. A compression spring 42 is placed between the blocks 34, 36 to normally bias them apart. Preferably there are counterbores formed in the faces of the blocks to accommodate the spring 42. The counterbores are sized such that together they can receive the entire spring when the tool is fully extended or advanced. This permits the faces of the jaw block 34 and unlocking block 36 to adjoin one another, as seen in FIGS. 9 and 10.

The slide assembly 32 reciprocates between extended and retracted positions. It is driven by a linear actuator, such as the air cylinder shown at 44. The air cylinder, of course, is connected to a suitable supply of compressed air and includes a suitable user-activated switch for controlling the flow of air to the cylinder. The cylinder is suitably fastened to the bracket 30. A pushrod 46 extends from the cylinder 44 through a bore in the bracket 30 and connects to the unlocking block 36. It will be understood that other types of actuators could be used, such as electro-mechanical actuators or hydraulic actuators.

The jaw block 34 carries a wire holder. In the illustrated embodiment the wire holder includes a pair of jaws 48A, 48B. The jaws are pivotably mounted on jaw pins 50A, 50B. The jaw pins 50A, 50B have their lower ends fixed to the jaw block 34 for reciprocating movement therewith. The jaw pins extend from the jaw block up through the slots 16A and 16B, respectively. The upper, free ends of the jaw pins mount the jaws for rotation on the pins. In addition to the rotational movement on the pins, the jaws also reciprocate with the slide assembly. That is, they move longitudinally on the surface of the bed 14.

The perimeter surfaces of each jaw 48A, 48B include a side cam follower 52, a leading edge 54, a gripping surface 56, a relieved edge 58 and a release cam follower 60. The side cam follower surface 52 is engageable with one of the cam rails 18A, 18B. The gripping surface 56 is an arcuate, preferably serrated surface. Together the gripping surfaces of the two jaws define a throat 57 between them into which an electric wire is placed. The gripping surface merges with the relieved edge 58. The release cam follower surface 60 spans the associated slot 16A or 16B and is adapted for engagement with an unlocking pin 62A or 62B. The unlocking pins are fixed in the unlocking block 36 for reciprocating movement with the unlocking block. Pins 62A, 62B extend up through the slots 16A, 16B and are releasably engageable with the release cam follower surfaces 60 of the jaws.

The rotational positions of the jaws 48A,B are controlled by the engagement of the side earn follower surface 52 with the sides cams rails 18A,B, respectively. As the slide assembly reciprocates the changing contour of the cam rails causes the jaws to pivot about the jaw pins 50A,B. It is further pointed out that the unlocking pins 62A,B are arranged to the inside of the jaw pins 50A, 50B. That is, the unlocking pins are closer to the longitudinal centerline of the bed 14 than are the jaw pins. With the unlocking pins arranged in this manner, contact between the unlocking pins and the release cam follower surfaces 60 will cause the jaws to rotate in a manner that releases the gripping surfaces 56 from a wire, i.e., jaw 48A will rotate clockwise (as seen in FIG. 1) about pin 50A while jaw 48B will rotate counterclockwise about pin 50B.

The carriage 26 is adapted to receive a push-in connector, such as the one shown at 64 in FIGS. 3-10. The push-in connector has a hollow housing or enclosure made of electrically insulating material. In this example the housing includes three wire openings (not shown) in an end face thereof. It will be understood that the interior of the housing includes a spring clip or other electrically conductive device that retains the wires inserted into the housing and electrically connects those wires. Alternately, there may be a separate retaining member and conductive busbar inside the connector housing. A single wire is shown at 66. The end of the wire has had its insulation stripped to expose a bare end 68 of the underlying conductor. The stripped end portion of the wire is inserted into the connector housing. Alternatively, the carriage could be adjustably fixed to the bed to permit the length of the depression to be altered to fit a particular connector housing. In this case the spacing between the notch 20 and the riser 22 and ledge 24 could be set so there is a snug fit of the connector housing on the carriage, thereby holding the connector fixed during operation of the slide assembly. As a further alternate, a clamp or stay could be arranged to retain the connector on the carriage, or a laterally movable mounting could be used.

Figure 3:
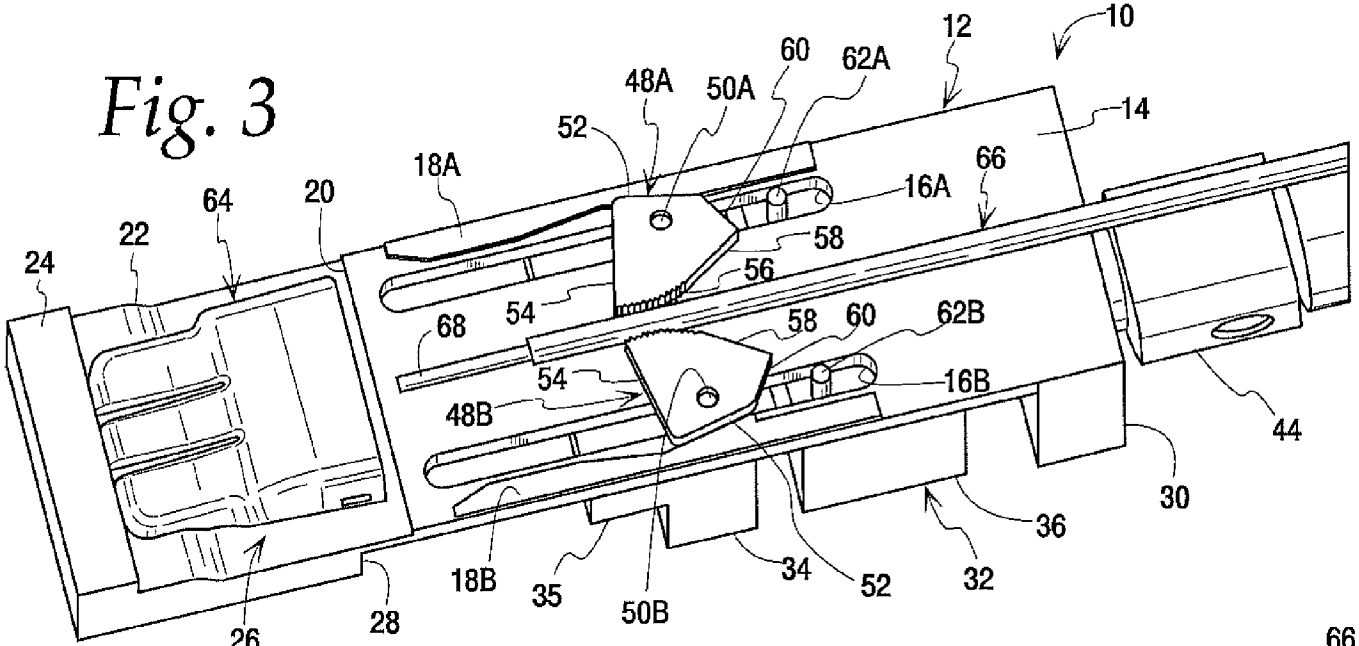
Figure 4:
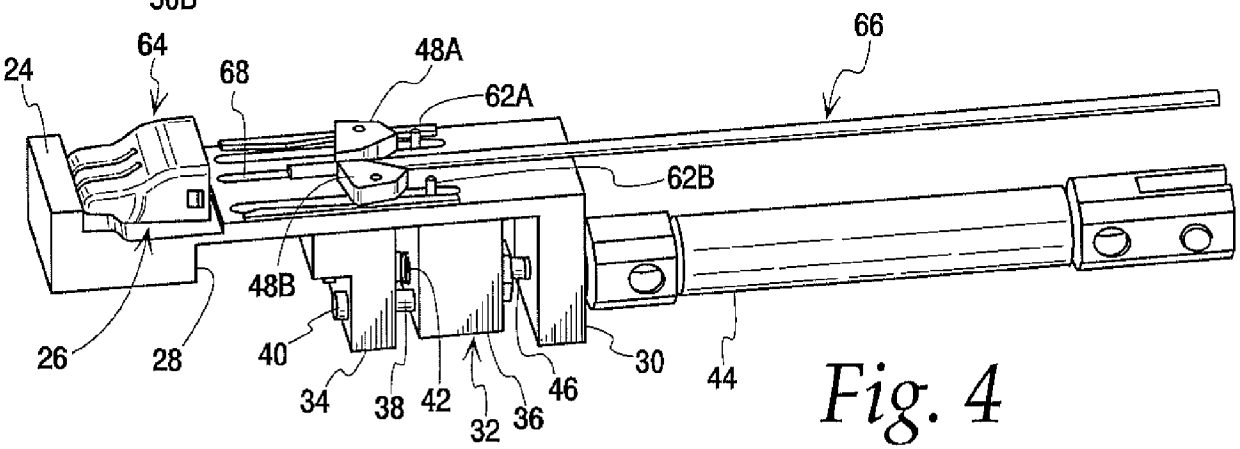
Figure 5:
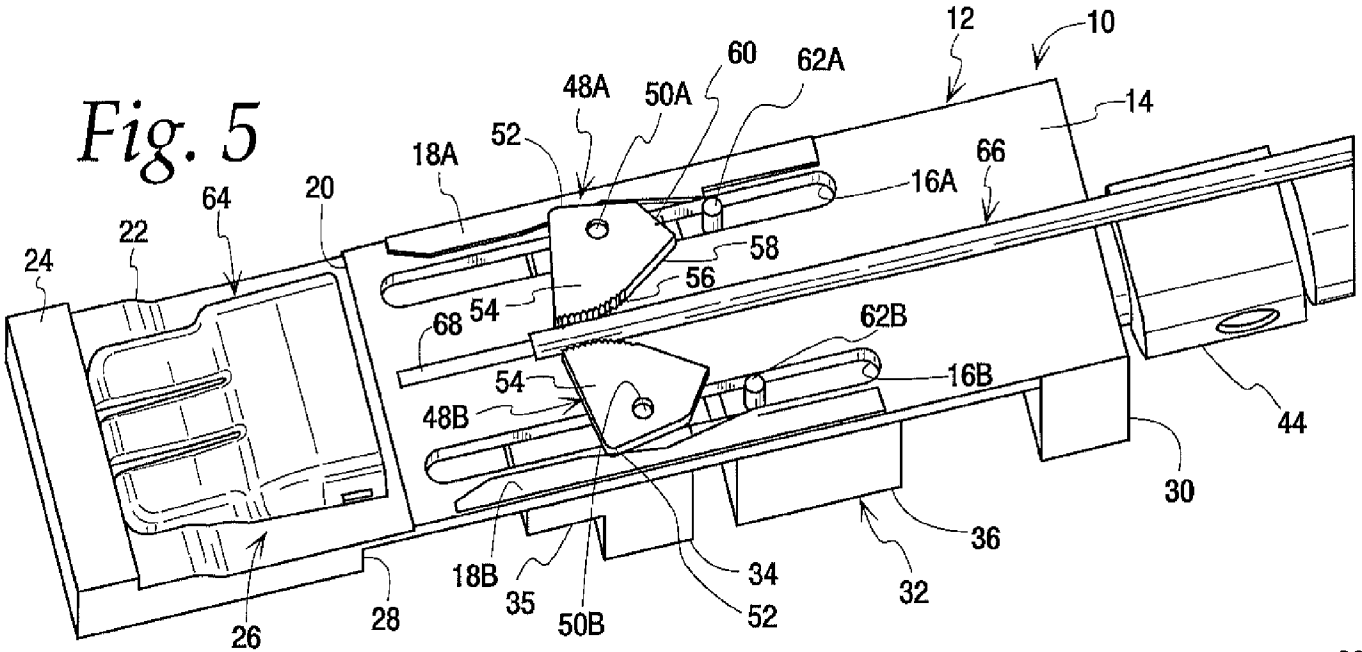
FIGS. 5 and 6 are perspective views of the wire installation tool of the present invention, shown in the partially advanced position with the wire holder jaws locked onto a wire. The line of sight of FIG. 5 is nearly a top plan view
Figure 6:
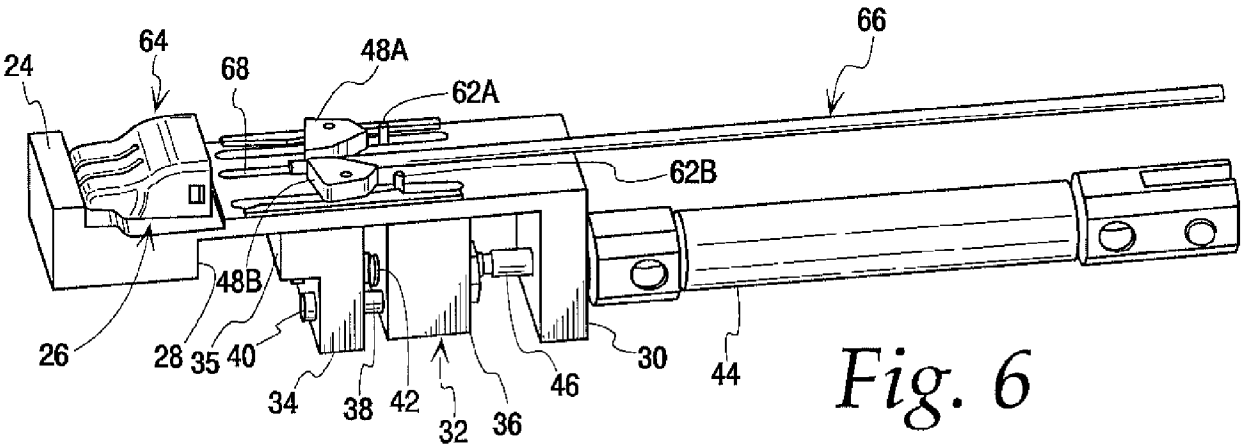

The use, operation and function of the invention are as follows. FIGS. 1 and 2 illustrate the wire insertion tool 10 in the fully retracted position ready for parts to be loaded therein. FIGS. 3 and 4 show the tool fully retracted with a push-in connector 64 loaded on the carriage 26 and a wire 66 loaded into the throat area between the jaws 48. The bare conductor 68 is aligned with the central opening of the connector housing. The user then activates the air cylinder 44 via a suitable switch. As the pushrod 46 advances it pushes the slide assembly 32 toward the connector. Movement of the jaw block 34 carries the jaws 48A,B into contact with a closing portion of the cam rails 18A,B, causing the jaws to close on the wire as seen in FIGS. 5 and 6. The wire subsequently moves axially with the slide assembly toward the connector housing.

Figure 7:
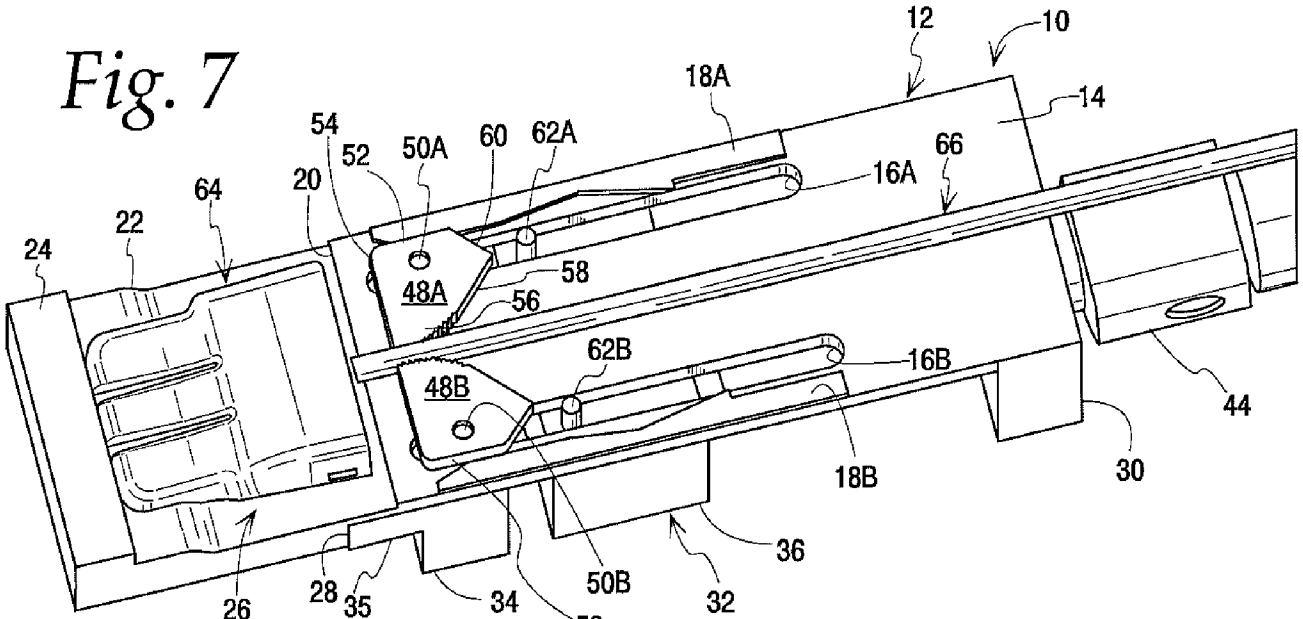
Figure 8:
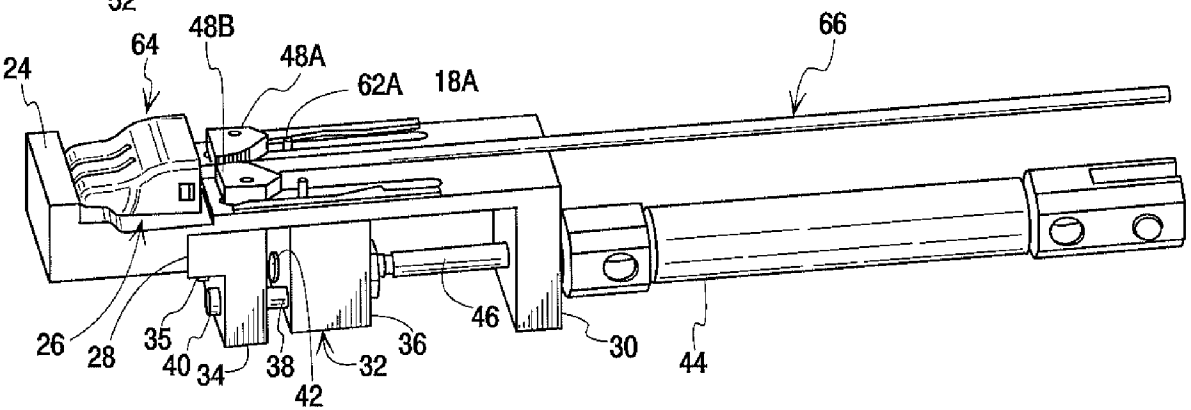

FIGS. 7 and 8 illustrate the point of the slide assembly advancement where the nose 35 of the jaw block engages the abutment 28. This stops movement of the jaw block, and consequently of the jaws and wire as well, at a position where the wire is fully inserted into the connector housing. The pushrod 46, however, continues to advance, pushing the unlocking block toward the jaw block and compressing the spring 42. The continued advancement of the unlocking block after the jaw block has been arrested by the abutment causes the unlocking pins 62A,B to rotate the jaws out of engagement with the wire, as described above. This is shown in FIGS. 9 and 10.

Note in FIGS. 9 and 10 how the guide rods 38 carry the heads 40 to a spaced location relative to the jaw block. With the jaws opened by the unlocking pins, the user can lift the joined wire and connector out of the tool and actuate the air cylinder control switch to retract the pushrod 46. Retraction will first cause separation between the unlocking block 36 and the jaw block 34, pulling the guide rods 38 back through the jaw block. The spring 42 will hold the nose 35 of the jaw block against the abutment 28 until the heads 40 reengage the jaw block. Then the jaw block will start to retract with the unlocking block and the entire slide assembly 32 will move as unit back to the starting point of FIGS. 1-4. At that time the user can reload the connector onto the carriage with a second housing opening aligned with the throat of the jaws. The first wire can be flexed slightly to overlie one of the jaws. A second wire is then loaded in the throat and the advancing stroke of the air cylinder repeats to insert the second wire as described above. A similar retraction stroke occurs after insertion of the second wire. If need be third (or more) wires are similarly inserted. It can be seen that all the operator has to do is position the connector and wires on the tool bed and activate the air cylinder. The pinching and advancing of the wire is then performed by the tool and the repetitive stresses on the operator are eliminated.

Figure 12:
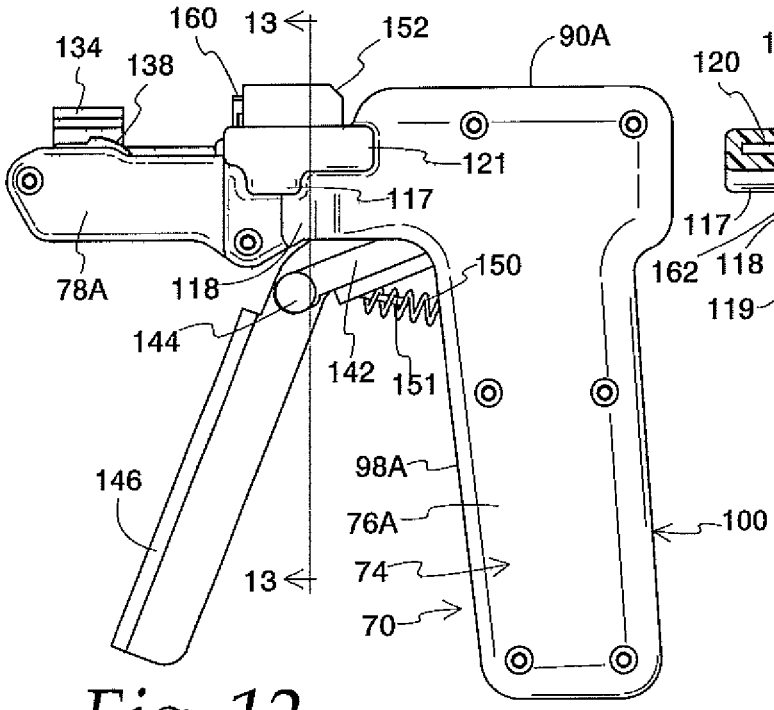
FIG. 12 is a side elevation view of the left or cover side of the hand-held insertion tool of FIG. 11.
Figure 13:
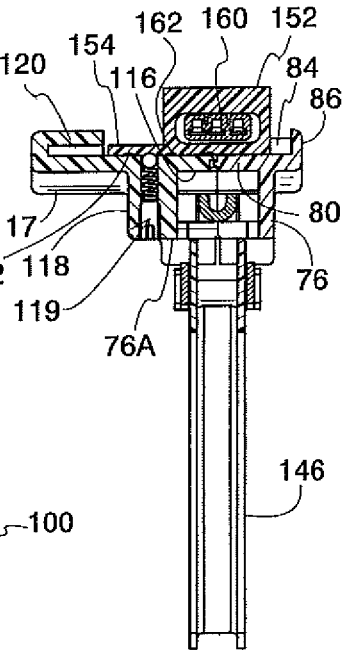
FIG. 13 is a section taken along line 13-13 of FIG. 12.
Figure 14:
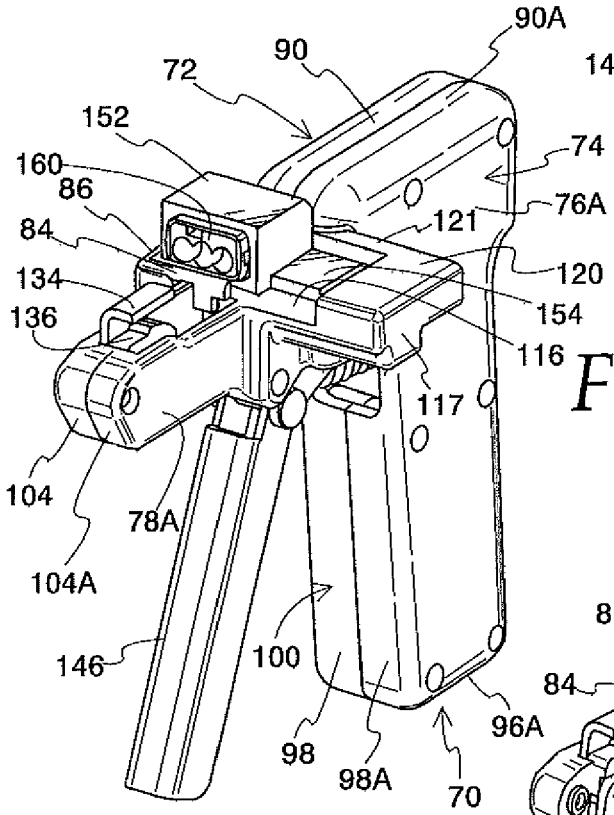
FIG. 14 is a perspective view of the front end of the tool.
Figure 15:
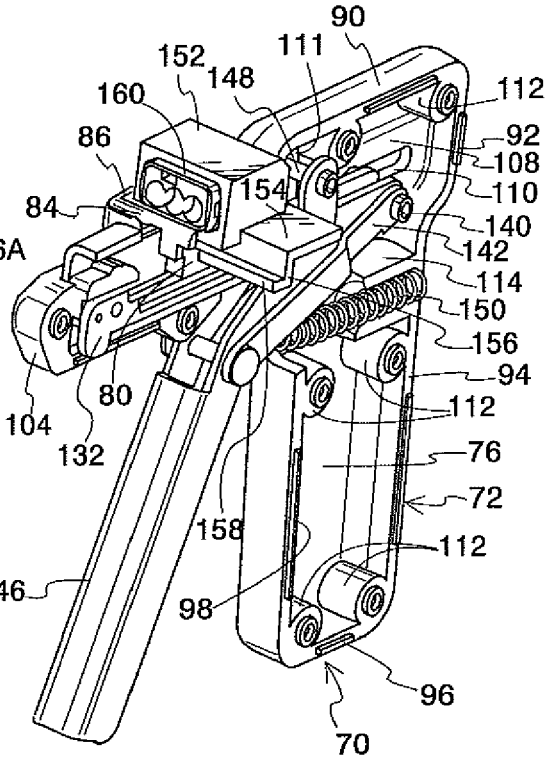
FIG. 15 is a perspective view similar to FIG. 14 but with the cover removed to illustrate the slide assembly and actuator in the interior of the case.
Figure 16:
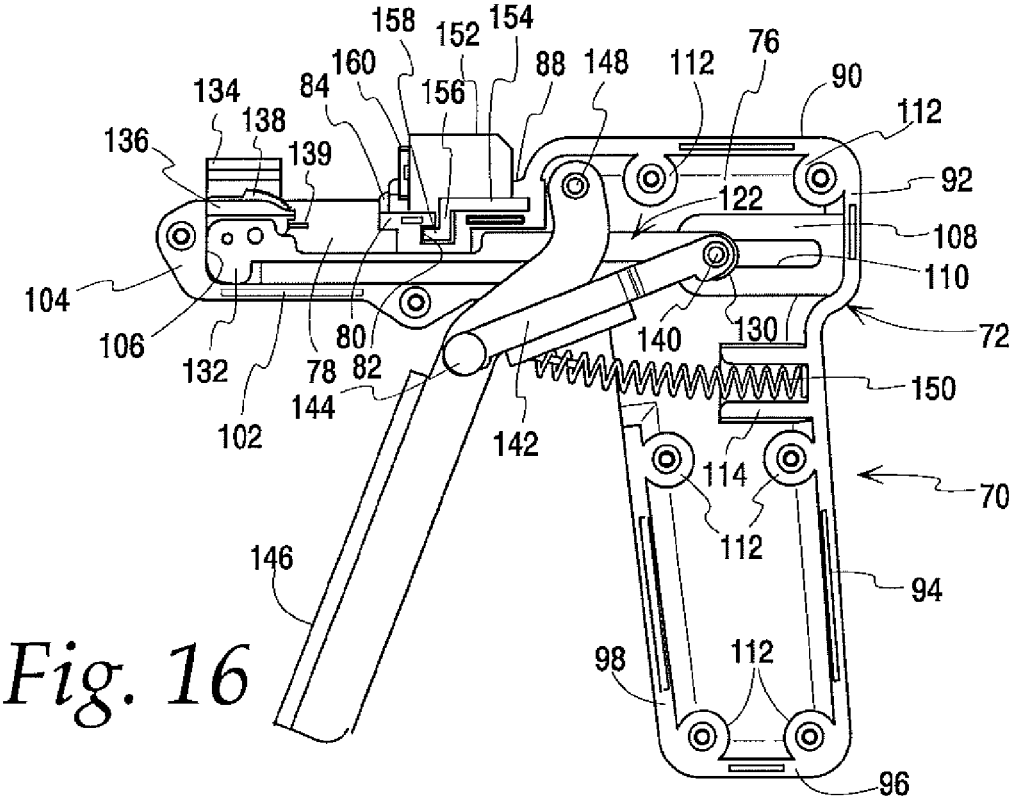
FIG. 16 is a side elevation view of the hand-held insertion tool with the cover removed.
Figure 17:
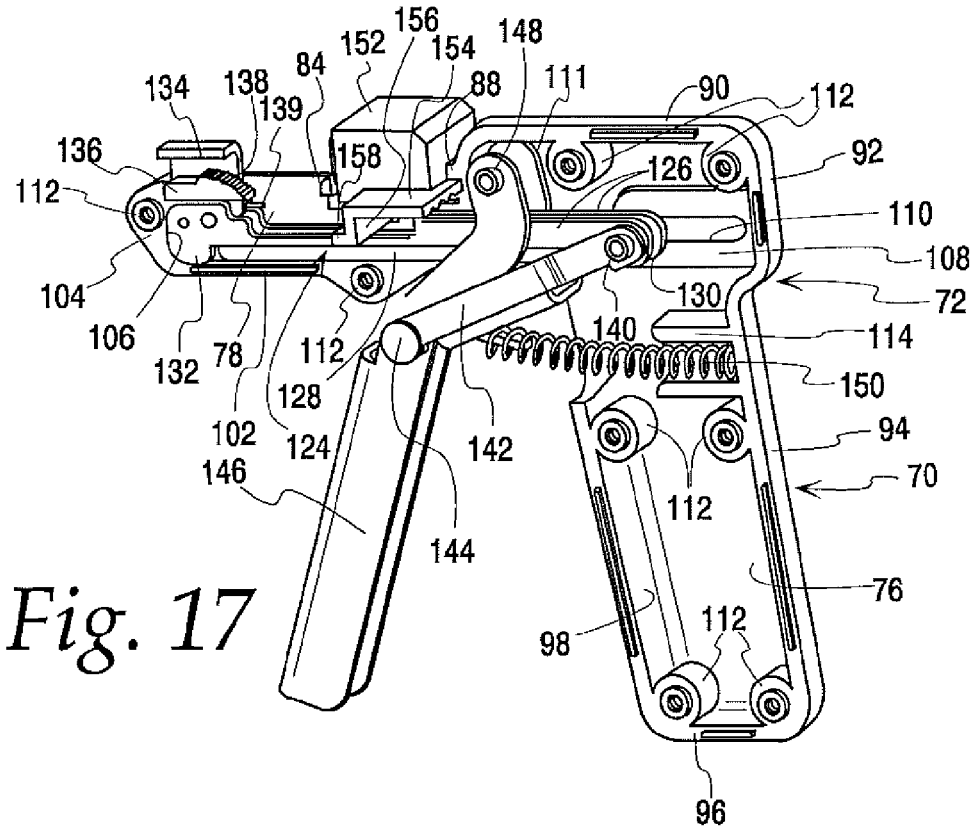
FIG. 17 is a perspective view of the hand-held insertion tool with the cover removed.

An alternate embodiment of the wire insertion tool is shown generally at 70 in FIGS. 11-18. This embodiment is a hand-held, hand-actuated, pistol-grip unit. Tool 70 has a two-piece housing that includes a generally hollow case 72 and a matching cover 74. FIGS. 15-17 illustrate that the case 72 has a side wall 76 which includes an extension 78. At the top of the extension there is a transversely-extending platform 80 which has an L-shaped channel 82 (FIG. 16) formed therein. This channel receives a foot of a carriage as will be explained below. The edges of the platform 80 are bounded in front by an upstanding transverse rail 84 and on the outside, i.e., the right side as seen in FIG. 13, by an upstanding longitudinal rail 86. The outside end of transverse rail 84 joins the front end of longitudinal rail 86. The rear end of rail 86 joins a transverse shoulder 88 (FIG. 16) which defines a slot between it and the platform 80 for receiving a lip of a carriage as will be explained later.

The case 72 further includes a top wall 90 which is perpendicular to the side wall 76 and extends from the shoulder 88 to a rear end wall 92. The rear end wall 92 curves to merge with a back perimeter wall 94. The back perimeter wall 94 in turn joins a bottom perimeter wall 96 that connects to a front perimeter wall 98. As is the case with the top and rear walls, the back, bottom and front perimeter walls 94, 96 and 98 are all perpendicular to the side wall 76. Together with the lower portion of the side wall 76 the perimeter walls form a handle 100.

FIGS. 15-17 illustrate the internal components of the case 72. Spaced below the platform 80 is a base plate 102 extending along the lower edge of the extension 78 and perpendicular thereto. The base plate 102 terminates at the front of the tool at a nose 104 that includes an internal cam actuating surface 106. At the end of the tool opposite the nose 104 there is an oval track 108 that is upraised and defines a pin-receiving race 110 therein. Somewhat above and to the front of track 108 is another circular pin-receiving enlargement (a small portion of which can be seen at 111 in FIGS. 15 and 17) formed on the inside of the side wall 76. At the upper corners of track 108 is a pair of bosses 112 having bores therein for receiving connecting screws extending through the cover 74. Another pair of such bosses 112 is found in the extension 78. Two similar pairs of bosses 112 are also found in the handle 100. A hollow spring seat 114 joins the back perimeter wall 94.

Figure 11:
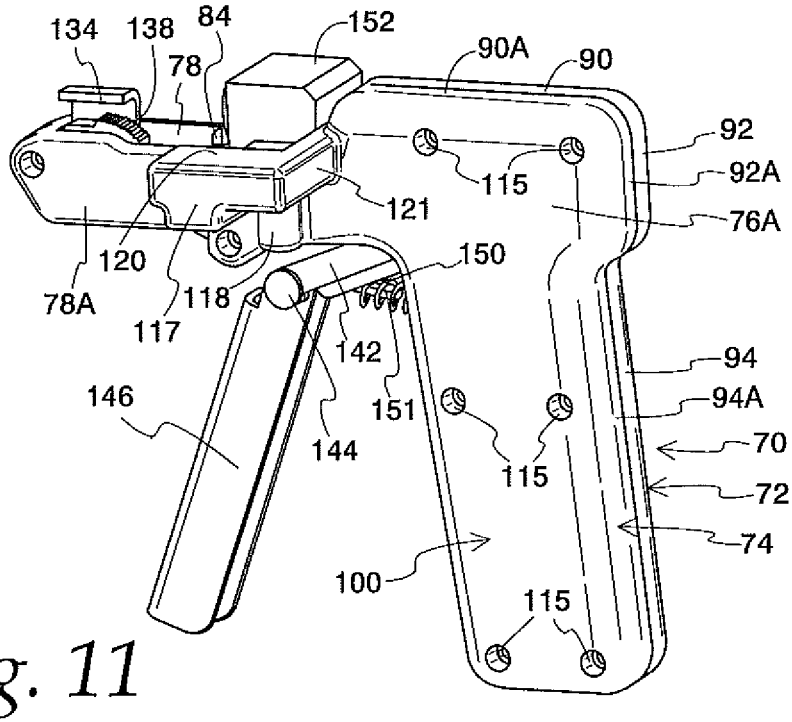
FIG. 11 is a perspective view of an alternate embodiment of the wire installation tool, showing the left or cover side of a hand-held, hand-actuated tool.

Turning now to FIGS. 11 and 12, it can be seen that the cover 74 has a perimeter shape generally complementary to that of the case 72. Cover parts generally corresponding to those of the case are designated with the same reference numeral with the letter A added, and their description will not be repeated. The cover is fastened to the case by screws (not shown) which extend through openings 115 in the cover and thread into the bores of the bosses 112 in the case. One area where the cover differs from the case is in the vicinity of the platform 80. Here the cover has a laterally extending flat deck 116 (FIG. 13). The top surface of the deck matches that of the platform. Underneath the deck there is a projection 117 in which a channel (not shown) is formed. This channel is shaped the same as the channel 82 in the case's platform 80. The two channels are aligned with one another. It will be noted that the top surface of the deck 116 and platform 80 is beneath the top of the transverse rail 84 for reasons which will be explained below. Adjacent to the projection 117 and depending from the deck 116 there is a cylindrical sleeve 118 having a bore through it. In the bore is positioned a detent mechanism 119 including a ball, spring and set screw. To the rear of the deck 116 is a lateral guide wall 121. A canopy 120 extends from the guide wall to the front edge of the deck 116. The canopy defines a hollow receptacle underneath it for entrapping the retainer plate of the carriage as will be set forth below.

Together the non-handle portions of the side walls 76, 76A, the extensions 78, 78A, the platform 80, the top walls 90, 90A, the rear end walls 92, 92A, the base plates 102, 102A, the noses 104, 104A, and the deck 116 define a frame portion of the housing. Inside this frame is a slide assembly 122. The slide assembly includes an elongated slide rod 124. The slide rod may be a generally U-shaped member having flat, upstanding sides 126 joined by a lower bight 128. The bight does not extend the full length of the pushrod, the sides of which define a clevis 130 at the rear end. At the front end each side 126 of the slide rod 124 has an enlarged head 132. One head further includes an upstanding extension terminating at a curved hood 134. Between the heads 132 and underneath the hood 134 there is pinned a cam 136. The cam has a curved, serrated wire gripping surface 138 which is biased toward the hood 134 by a torsion spring 139 (FIGS. 16 and 17). The slide rod 124 is slidably mounted on the base plates 102, 102A. The hood 134 extends above the open top of the extensions 78, 78A.

The slide rod 124 is connected to an actuator. In the illustrated embodiment the slide rod's clevis 130 carries a link pin 140. The ends of the link pin 140 are mounted for reciprocating movement in the races 110. The link pin 140 also extends through a clevis at one end of a pushrod 142. The other end of pushrod 142 is pinned by a trigger-link pin 144 to a trigger 146. Trigger 146 is pivotably connected to the housing by a main pivot pin 148. The ends of the main pivot pin 148 are carried in the circular pin-receiving enlargements 111. The pushrod 142 and trigger 146 are constructed similarly to the slide rod 132. That is, they each are generally U-shaped members having flat sides joined by a bight which does not extend the full length of the member. The sides define a single clevis at the top of the trigger for the main pivot pin 148 while the sides define two clevises, one at each end of the pushrod 142. Advantageously, all of the slide rod 124, pushrod 142 and trigger 146 may be made of stampings which are rolled to shape, although it will be understood that other suitable forms and manufacturing methods are possible for each of these three elongated members.

A return spring 150 has one end held in the spring seat 114. The other end of the return spring surrounds a tang 151 that extends from the pushrod 142. The return spring urges the trigger 146 away from the handle 100 to a rest or extended position.

A wire connector holder in the form of a carriage 152 is disposed generally above the platform 80 and deck 116. The main part of the carriage is a generally five-sided box or enclosure which is open to the front of the tool. There is a lateral Z-shaped extension (FIG. 16) attached to the enclosure. It includes a flat plate 154, a front leg 156 and a foot 158 connected to the leg. The foot tucks under the platform 80 and deck 116 and is slidable in the channel 82 in the platform and projection 117. The rear edge of the plate 154 adjoins the lateral guide wall 121 of the cover 74 and is slidable in the slot defined under the shoulder 88 of the case. The plate 154 also fits into the receptacle defined by the canopy 120. Thus, the carriage is movable laterally between a connector loading position, which is all the way to the left, and a wire insertion position, which is toward the longitudinal rail 86. A user can push or pull the carriage 152 to a different desired position as needed for either aligning a connector opening with the slide rod or for mounting or dismounting a connector in the carriage. It is noted that the longitudinal rail 86 limits the rightward sliding of the carriage, while the canopy 120 limits leftward sliding of the carriage. Engagement of the foot 158 with the deck 116 and platform 80 and engagement of the plate 154 with the shoulder 88 prevents lifting the carriage off the tool.

It will be noted in FIG. 14 that when the carriage 152 is in a wire insertion position the transverse rail 84 is engageable with the wire connector 160, which prevents the connector from coming out of the carriage. When the carriage is moved all the way to the left, to the connector loading position, the connector clears the rail 84. The reduced height of the deck 116 allows the connector to be placed into or taken out of the carriage.

FIG. 13 shows that on the underside of the carriage plate 154 there is a series of longitudinal grooves 162. These receive the ball of the detent mechanism 119 to releasably hold the carriage 152 in a selected position. The right-most groove in FIG. 13 defines the connector loading position. The other three grooves define wire insertion positions. In each of these positions one of the openings in the housing of the wire connector 160 is aligned with the slide rod 124 and the wire gripping surface 138. The user locates the carriage 152 to align an available connector opening with the slide rod, which makes the connector ready for insertion of a wire.

The use, operation and function of the wire insertion tool are as follows. First a push-in wire connector 160 has to be loaded into the carriage. As just mentioned this is done by pushing or pulling the carriage 152 onto the deck 116 to the connector loading position. As viewed by a user holding the tool in his or her hand for actuation, with the thumb around the handle 100 and the fingers wrapped around the trigger 146, the carriage is moved to the user's left for loading the carriage. This allows the carriage cavity to clear the transverse rail 84. The connector 160 is pressed into the cavity in the carriage through the open front side of the carriage. The connector is oriented so its openings face the front of the tool. In fact, the cavity of the carriage is preferably shaped to receive the connector in only the correct orientation; it won't fit if inserted backwards or sideways. Then the carriage is moved to the right to align the first connector opening with the cam 136 of the slide assembly 124. The detent grooves 162 interact with the detent mechanism 119 to provide tactile feedback when the carriage is in the correct position. With the carriage in one of the wire insertion positions the transverse rail 84 will partially close the cavity of the carriage to retain the connector in the carriage. Next, the end of a wire to be inserted is placed in the slide assembly, between the wire gripping surface 138 and the hood 134. The stripped end of the wire faces the connector 160 with a portion of the wire's insulation adjacent the serrated wire gripping surface 138.

Figure 18:
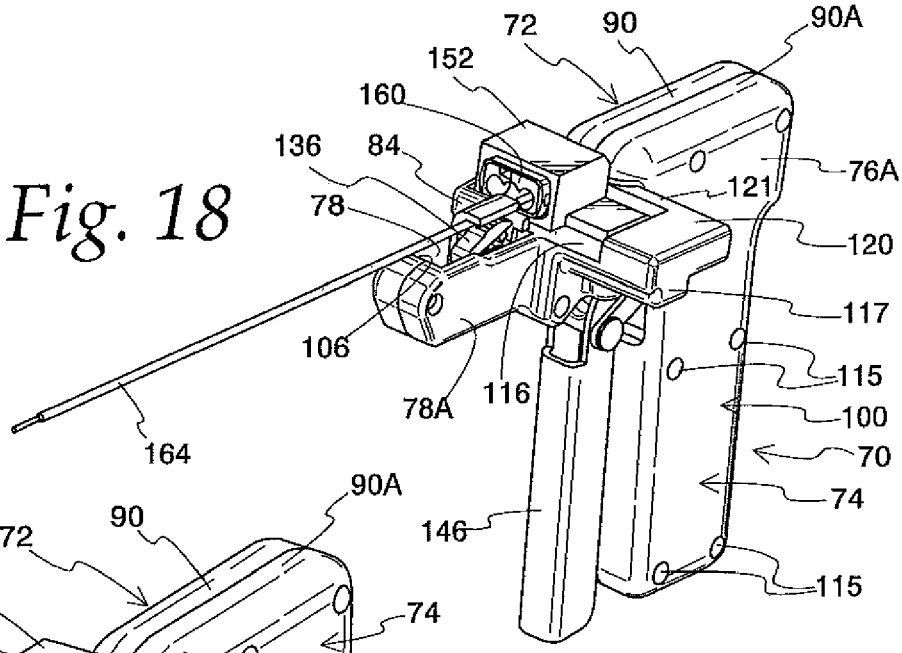
FIG. 18 is a perspective view similar to FIG. 14 but showing a wire mounted in the slide assembly and the trigger actuated to move the slide assembly toward a push-in wire connector.

The user then squeezes the trigger 146. The pivoting trigger pushes the pushrod 142 backwards toward the rear of the tool. The link pin 140 also moves rearwardly but is constrained by the oval track 108, 108A to move in a horizontal direction only. This draws the slide rod 124 rearwardly. As the slide rod moves, it pulls the cam 136 out of engagement with the cam actuating surface 106 of the nose 104. This permits the torsion spring 139 to rotate the cam toward the hood 134, thereby gripping the wire firmly in the slide assembly. The arrangement of the cam gripping surface and the location of the cam's pivotal mounting to the slide rod create a self-locking action of the cam on the wire. Continued squeezing of the trigger advances the wire held by the cam 136 toward the opening in the connector 160. This is shown in FIG. 18 with the wire illustrated at 164. Once the wire is seated in the connector the user releases the trigger. The return spring 150 pushes the trigger 146 back toward the extended or rest position. This also advances the slide rod to the front of the tool. Slide rod movement toward the nose allows the cam to rotate to an unlocked condition with respect to the wire. When the cam 136 hits the cam actuating surface 106 the cam rotates to the loading position of FIG. 14, ready for the next wire. The user slides the carriage 152 in the appropriate direction to align the next empty connector opening with the cam 136. The next wire is mounted in the slide assembly and the wire insertion process is repeated. This is done for as many wires as needed or desired.

Once all of the wires are inserted, the carriage is returned to the connector loading position, i.e., to the left of the tool. This allows the connector cavity to clear the transverse rail 84 which in turn permits removal of the connector from the carriage. The tool is then ready to receive the next wire connector.

While the preferred form of the invention has been shown and described herein, it should be realized that there may be many modifications, substitutions and alterations thereto. For example, the wire holder could be adapted to insert multiple wires in a single full stroke of the slide assembly. Or, the wire holder or carriage could be connected to the slide assembly to index the carriage laterally during a return stroke so the carriage is automatically positioned for the next wire to be inserted. The manual actuator of the pistol grip unit could be replaced by a powered actuator. Also, while the motion of the slide assemblies shown herein is strictly linear, it wilt be understood that some non-linear motion could be accommodated so long as the component of slide motion immediately before wire insertion is parallel to the entry axis of the connector housing. Thus, for example, the slide assembly could impart an initially arcuate motion to the wire holder which arcuate motion then concludes with a tangential component that is parallel to the entry axis, thereby inserting the wire parallel to the entry axis.

We claim:

1. A wire insertion tool for installing electric wires in a push-in wire connector, the push-in connector having a housing with at least one opening therein defining an entry axis, the wire insertion tool comprising:

a frame including a carriage for releasably mounting a push-in wire connector thereon;

a slide assembly including a wire holder which releasably grips an electric wire having a longitudinal axis that is parallel to the entry axis when mounted in the wire holder, the slide assembly being mounted for reciprocating motion on the frame toward and away from the carriage in a direction which includes a component that is parallel to the entry axis of the wire connector; and an actuator connected to the slide assembly for selectably reciprocating the slide assembly and wire holder toward and away from the carriage to insert in a motion along its longitudinal axis an electric wire mounted in the wire holder into a wire connector mounted on the carriage.

2. The wire insertion tool of claim 1 wherein the carriage is movable in a direction transverse to the direction of the entry axis of the wire connector.

3. The wire insertion tool of claim 2 wherein the carriage has a cavity for receiving a wire connector therein and the carriage is movable between a first position wherein connectors can be loaded into and unloaded from the cavity and at least one other position wherein wires can be inserted into a connector, and the frame includes a transverse rail which lies adjacent the cavity when the carriage is not in the first position to prevent removal of a connector from the cavity when the carriage is in one of said other positions.

4. The wire insertion tool of claim 1 further comprising a handle connected to the frame.

5. The wire insertion tool of claim 4 wherein the actuator comprises a trigger pivotally connected to the frame, the trigger being connected to the slide assembly by a pushrod.

6. The wire insertion tool of claim 5 further comprising a return spring mounted in the handle and urging the trigger away from the handle.

7. The wire insertion tool of claim wherein 1 wherein the slide assembly includes a slide rod having a cam pivotally connected thereto and the frame includes a cam actuating surface engageable with the cam when the slide rod is in rest position.

8. The wire insertion tool of claim 7 wherein the slide rod further includes a hood disposed opposite the cam for gripping electric wires inserted between the cam and the hood.

9. A wire insertion tool for installing electric wires in a push-in wire connector, the push-in connector having a housing with at least one opening therein defining an entry axis, the wire insertion tool comprising:

a frame including a carriage for releasably mounting a push-in wire connector thereon;

a slide assembly including a wire holder which releasably grips an electric wire mounted in the wire holder, the slide assembly being mounted for reciprocating motion on the frame toward and away from the carriage in a direction which includes a component that is parallel to the entry axis of the wire connector; and an actuator connected to the slide assembly for selectably reciprocating the slide assembly and wire holder toward and away from the carriage to insert an electric wire mounted in the wire holder into a wire connector mounted on the carriage;

wherein the slide assembly further comprises a hood disposed opposite a cam for gripping electric wires inserted between the cam and the hood.

10. A wire insertion tool for installing electric wires in a push-in wire connector, the push-in connector having a housing with at least one opening therein defining an entry axis, the wire insertion tool comprising:

a frame including a carriage for releasably mounting a push-in wire connector thereon;

a slide assembly including a wire holder which releasably grips an electric wire having a longitudinal axis that is parallel to the entry axis when mounted in the wire holder, the slide assembly being mounted for reciprocating motion on the frame toward and away from the carriage in a direction which includes a component that is parallel to the entry axis of the wire connector; and an actuator connected to the slide assembly for selectably reciprocating the slide assembly and wire holder toward and away from the carriage to insert in a motion along its longitudinal axis an electric wire mounted in the wire holder into a wire connector mounted on the carriage;

wherein the slide assembly further comprises a hood disposed opposite a cam for gripping electric wires inserted between the cam and the hood.

* * * * *